US005209712A

United States Patent [19]

Ferri

[11] Patent Number: 5,209,712

[45] Date of Patent: May 11, 1993

[54] PROPRIOCEPTIVE EXERCISE, TRAINING AND THERAPY APPARATUS

[76] Inventor: Frederic Ferri, 1013 Fountain St., Ann Arbor, Mich. 48103

[21] Appl. No.: 720,270

[22] Filed: Jun. 24, 1991

[51] Int. Cl.[5] ..... A63B 21/02

[52] U.S. Cl. ..... 482/91; 482/131; 482/139

[58] Field of Search ..... 272/61, 62, 93, 144, 272/145, 900, 125, 109, 136, 142; 482/91, 131, 136, 139, 23, 24, 38–43, 23

[56] References Cited

U.S. PATENT DOCUMENTS

| | | | |
|---|---|---|---|
| 775,989 | 11/1904 | Roberts | 272/900 |
| 3,119,614 | 1/1964 | Berry | 272/125 |
| 3,593,708 | 7/1971 | Steele | 272/61 |
| 4,492,373 | 3/1978 | Pzitzer | 272/61 |
| 4,830,365 | 5/1989 | March | 272/136 |
| 4,927,138 | 5/1990 | Ferrari | 272/70 |

FOREIGN PATENT DOCUMENTS

| | | | |
|---|---|---|---|
| 0529810 | 9/1956 | Canada | 272/900 |
| 2403088 | 5/1979 | France | 272/142 |

*Primary Examiner*—Robert Bahr
*Assistant Examiner*—Jerome Donnelly
*Attorney, Agent, or Firm*—Rodger H. Flagg

[57] ABSTRACT

A proprioceptive exercise, training and therapy apparatus is disclosed for supporting and stabilizing at least a portion of the user's body and limbs from at least one elongated flexible support member. Each flexible support member is releasably secured to a selected structural support means. A plurality of attachment points are provided in sequential linear alignment on the flexible support member. An adjustable positioning means is provided on each flexible support member. A first user engagement member is in the form of a rigid, rectangular bar. A second user engagement member is in the form of a flexible body sling, with ends adapted for releasable securement to at least one flexible support member. A third user engagement member comprises at least one hand and foot coupling member, releasably secured to the flexible support member or to a suitable retaining means.

22 Claims, 8 Drawing Sheets 34
36
80
86
62
63
60
66
26
29
27
70
72
50
59
54
46
44
48
42
40
22
20
28
31
32
30
24
90

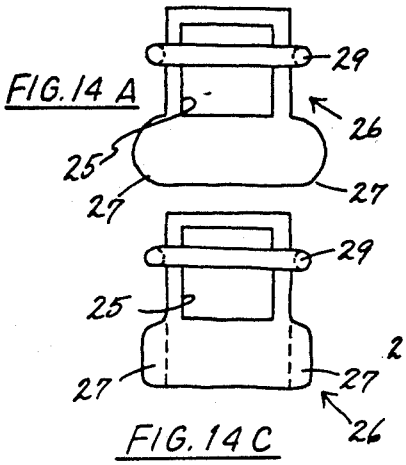
FIG. 14 A
FIG. 14 C
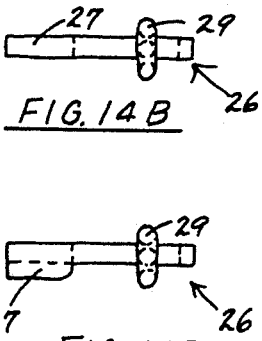
FIG. 14 B
FIG. 14 D
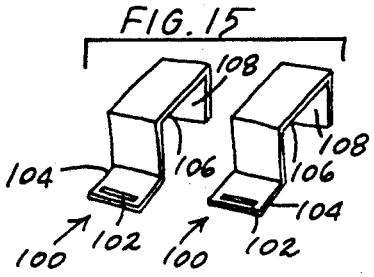
FIG. 15
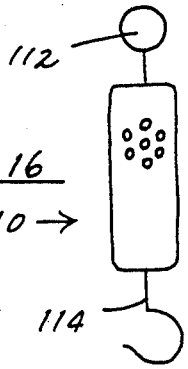
FIG. 16
FIG. 13
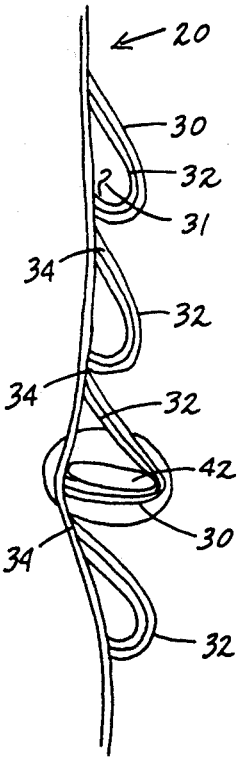
FIG. 17 A
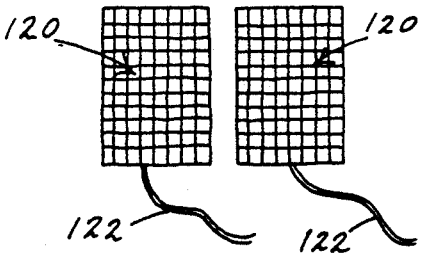
FIG. 17 B
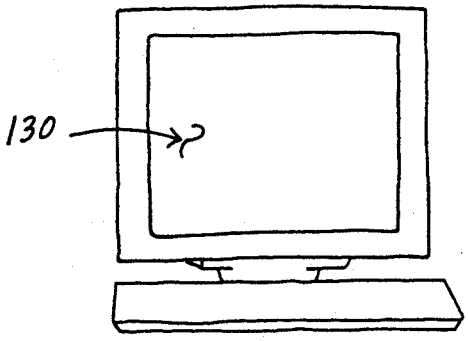

PROPRIOCEPTIVE EXERCISE, TRAINING AND THERAPY APPARATUS

BACKGROUND OF THE INVENTION

This invention relates generally to physical fitness apparatus, and more specifically to proprioceptive exercise, training and therapy apparatus for developing and maintaining agility, coordination, muscle strength, balance and skeletal alignment through application and development of yoga principals of isolating, stretching, tensioning or rotating particular muscles and/or groups of muscles.

For purposes of this invention, the term proprioceptive training and therapy is defined as: efforts undertaken to maximize and extend one's neuro-muscular-skeletal self-awareness through integration and optimization of mental, biological and physical performance by developing and maintaining optimal, joint function, agility, coordination, concentration, muscle strength and balance. Applications include therapeutic evaluation and rehabilitation, athletic skill assessment and improvement, and general fitness conditioning.

The practice of yoga and yoga related techniques has long been recognized as a beneficial regimen for health and physical fitness. To date no comprehensive physical fitness equipment has been developed to assist user's in developing and maintaining proprioceptive training and therapy.

YOGA: A GEM FOR WOMEN by Geeta S. Iyengar, Allied Publishers Private LTD., New Dehli, published in 1983 discloses various YOGA exercises using two rings suspended from ropes secured to a wall. Exercises using a bench and a block are also disclosed.

A pelvic swing popularized by Mr. Iyengar provides a means for inversion. It clips to eye hooks secured to the ceiling.

Upper and lower wall ropes have also been popularized by Mr. Iyengar. His wall ropes extend from eye hooks in the wall.

The YOGA JOURNAL, in July/August 1988 published an article entitled "Yoga with Ropes", on pages 58 through 62, which provide more details of the Pelvic Swing and Wall ropes popularized by B.K.S. Iyengar.

U.S. Pat. No. 4,492,373 discloses a body therapeutic and exercising apparatus having a pair of hangers with at least one rigid cylindrical bar connected to the hangers. A sling is also suspended from the hangers. Chain is used to support the sling.

U.S. Pat. No. 4,606,539 discloses a physical therapy device having a rigid cylindrical rod covered by padding material. Straps or belts extend from the rod for attachment to the treatment surface, located beneath the user.

U.S. Pat. Nos. 4,077,403 and 3,593,708 relate to body suspension devices supported within a doorway frame.

U.S. Pat. No. 4,531,514 discloses an orthopedic traction apparatus using rope or chain and pulleys to adjustably position a trapeze bar.

U.S. Pat. No. 4,277,062 discloses a leg stretching exercise apparatus having multiple limb and body attachments.

The heretofore known exercise apparatus do not provide a comprehensive proprioceptive training and therapy apparatus, as disclosed herein. Objects and advantages of this invention will become apparent by reference to the following description and accompanying drawings.

SUMMARY OF THE INVENTION

In accordance with the present invention, a proprioceptive exercise, training and therapy apparatus is disclosed for supporting at least a portion of the user's body and limbs from at least one elongated flexible support member preferably having a generally rectangular configuration. Each flexible support member is releasably secured to a selected structural support means, such as a ceiling, wall, supporting frame, tree branch, etc.

Preferably, more than one structural support means is selected to support more than one flexible support member. An adjustable positioning means may be provided on each flexible support member or user engagement member to adjustably position the height of the user engagement member to suit alignment of a selected portion of the flexible support member with a selected portion of the user's body or limbs.

Preferably, a first user engagement member is in the form of a rigid, rectangular bar having a resilient covering. The ends of the rectangular bar are adapted to be releasably secured to at least one flexible support member. One or more attachment points are provided along flexible support member to receive the ends of the rectangular bar.

A second user engagement member is in the form of a flexible body sling having a resilient covering, with ends adapted for releasable securement to at least one flexible support member.

A third user engagement member comprises at least one hand and foot coupling member, releasably secured to at least one flexible support member. In combination, the three user engagement members together with at least one flexible support member adapted for support from selected multiple support positions, provide a comprehensive exercise, training and therapy apparatus, in accordance with the disclosure provided.

IN THE DRAWINGS

Figure 6:
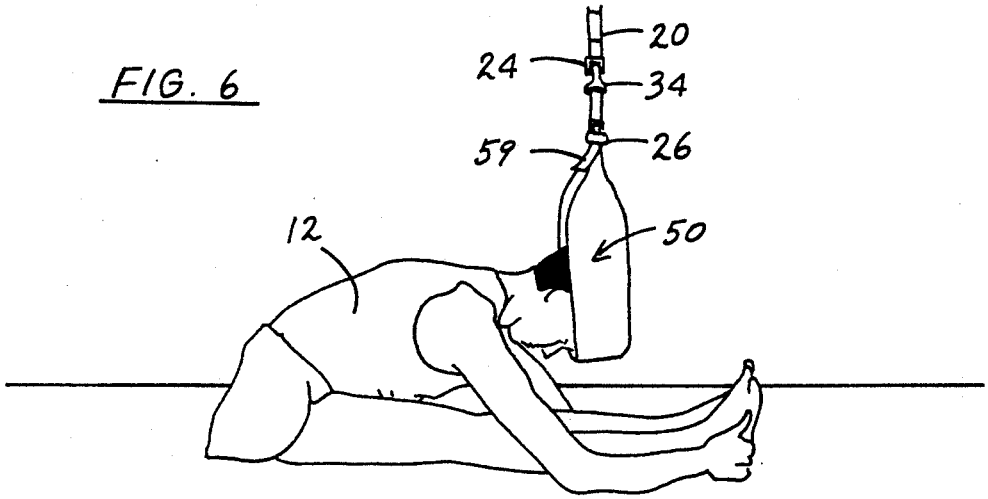

FIG. 6. is a perspective view of the apparatus showing the flexible sling positioned for use in partially supporting the user's forehead from a seated position.

Figure 7:
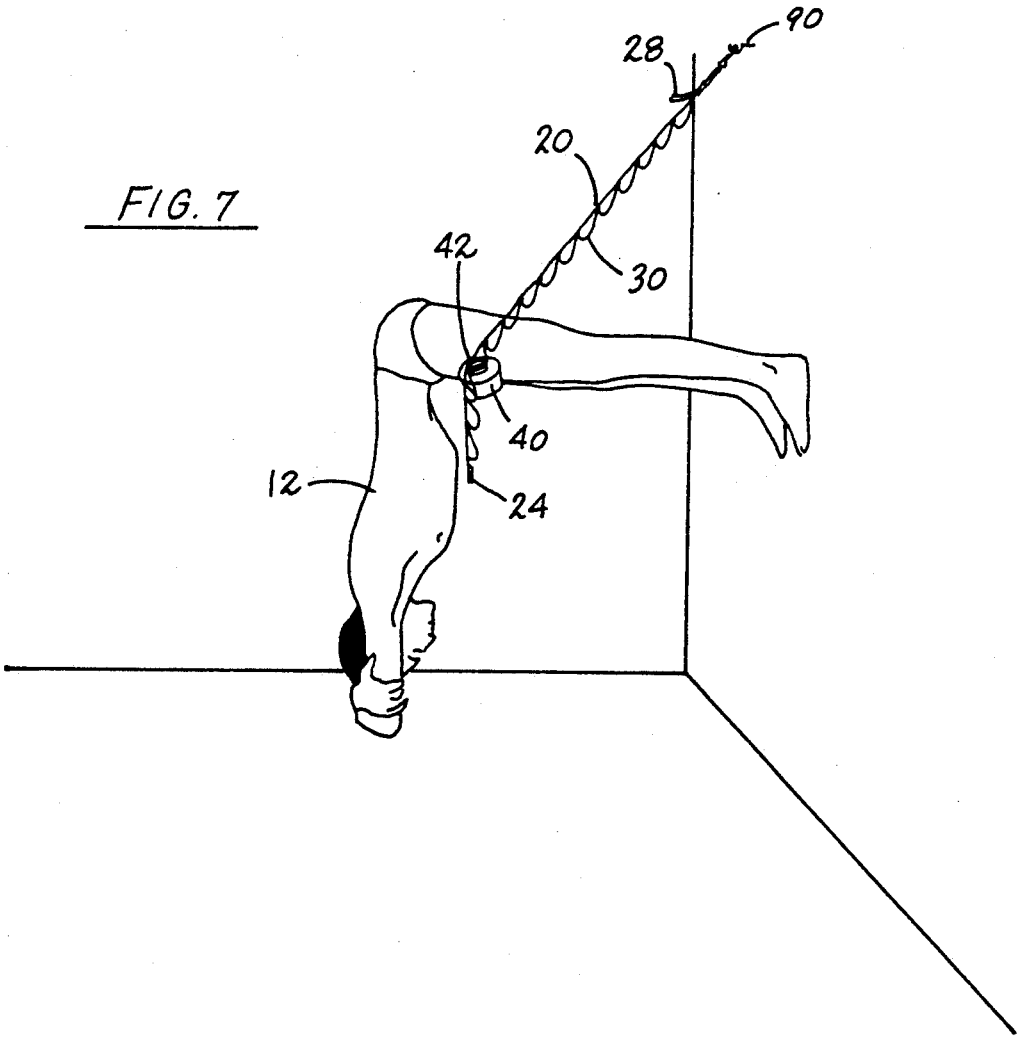

FIG. 7 is a perspective view of the apparatus showing the user flexed at the hips with active extension of the legs.

Figure 8:
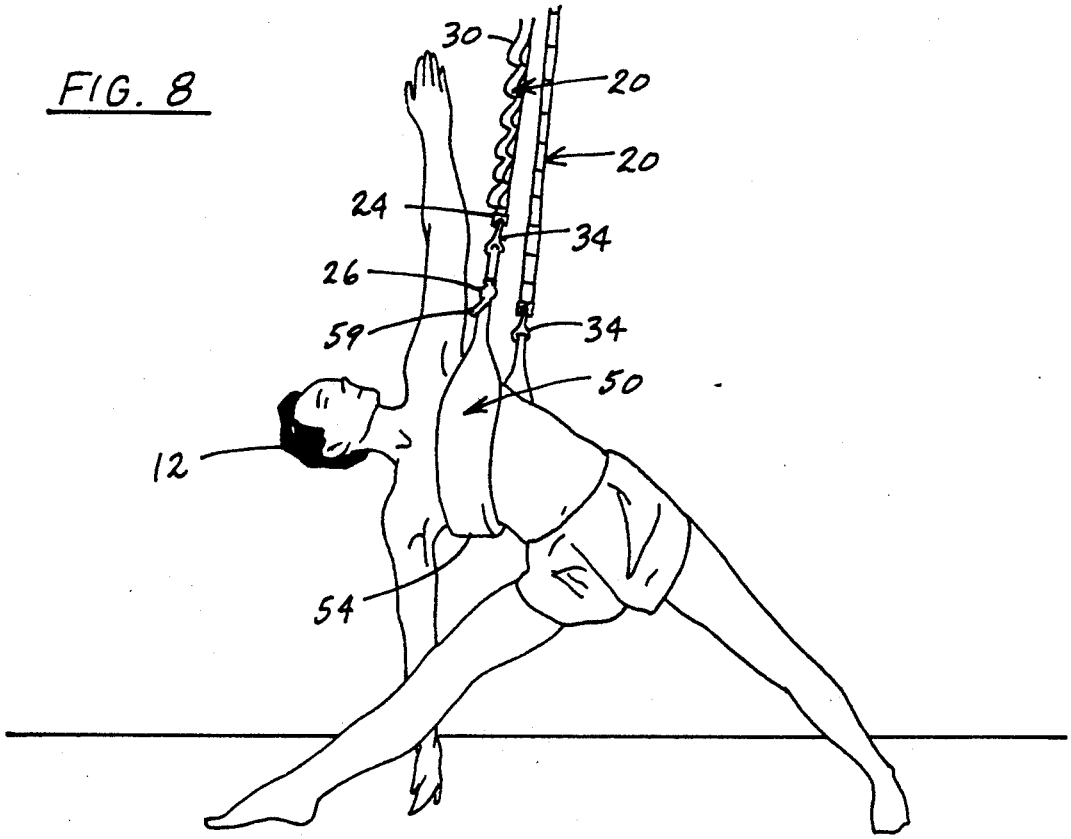

FIG. 8 is a perspective view of the apparatus showing the flexible sling positioned for use with the upper torso.

Figure 9:
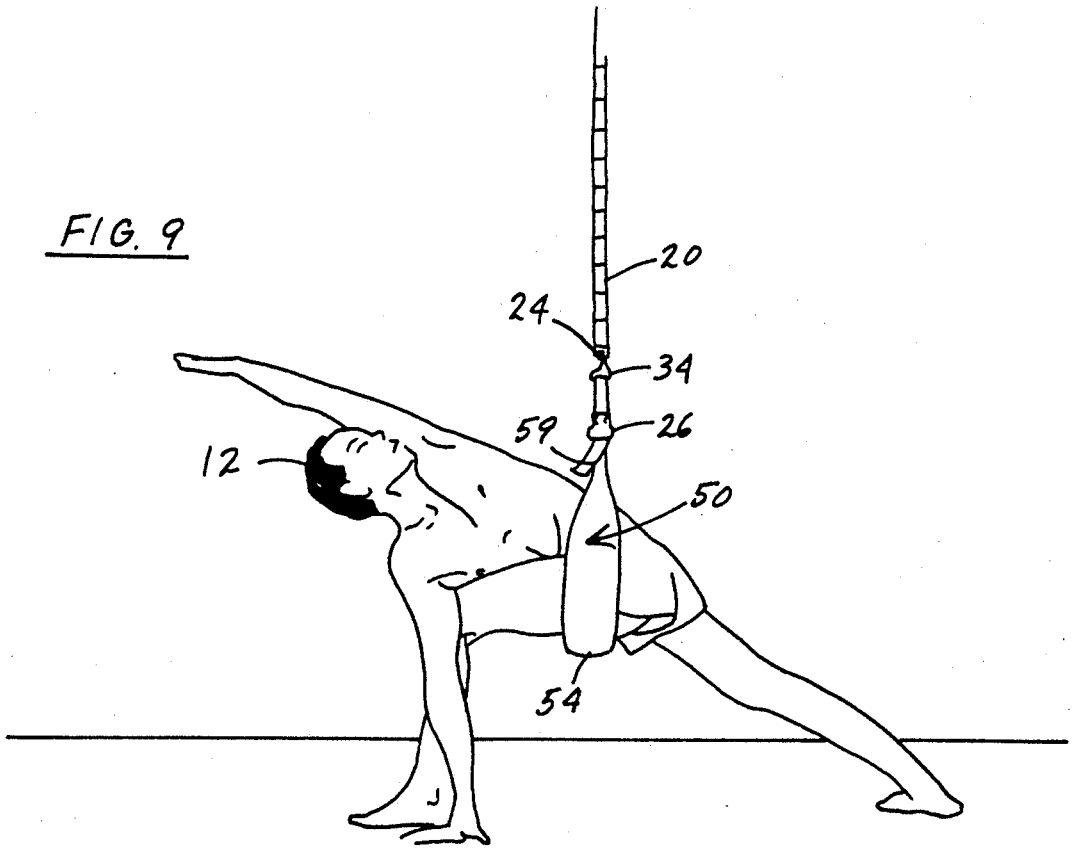

FIG. 9 is a perspective view of the apparatus showing the flexible sling positioned for partially supporting the user's hip.

Figure 10:
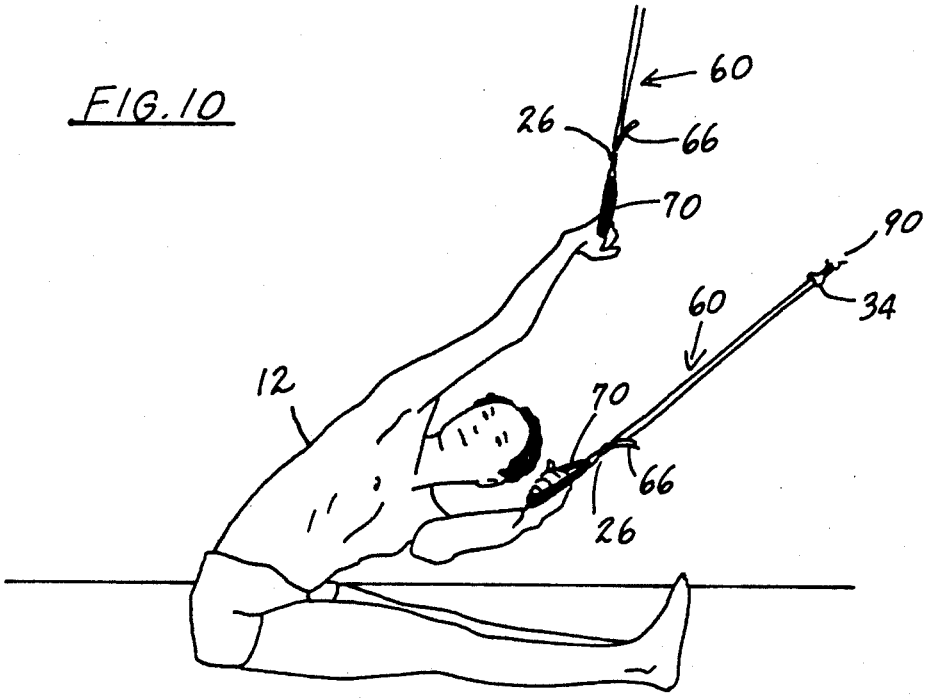

FIG. 10 is a perspective view of the apparatus showing two hand and foot coupling members positioned for use from a seated position.

Figure 11:
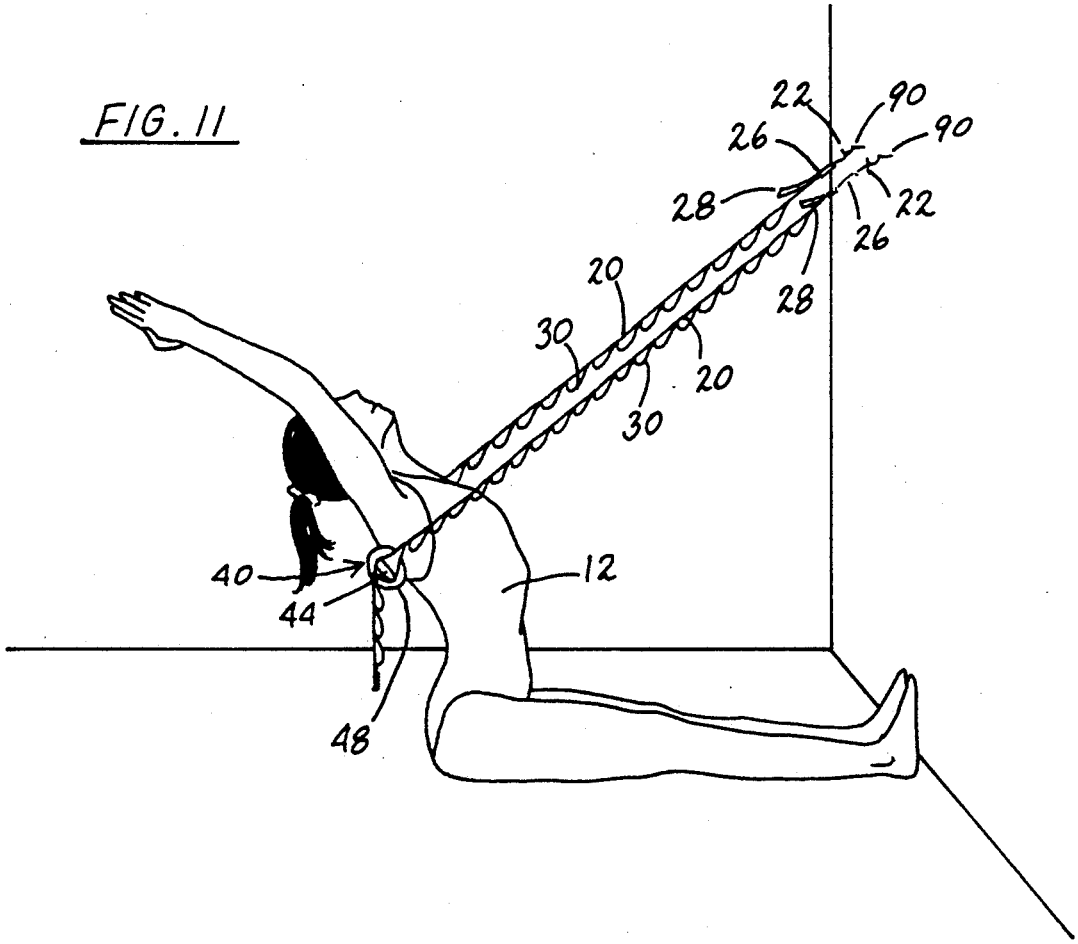

FIG. 11 is a perspective view of the apparatus showing the rigid bar selectively positioned for use from a seated position.

Figure 12:
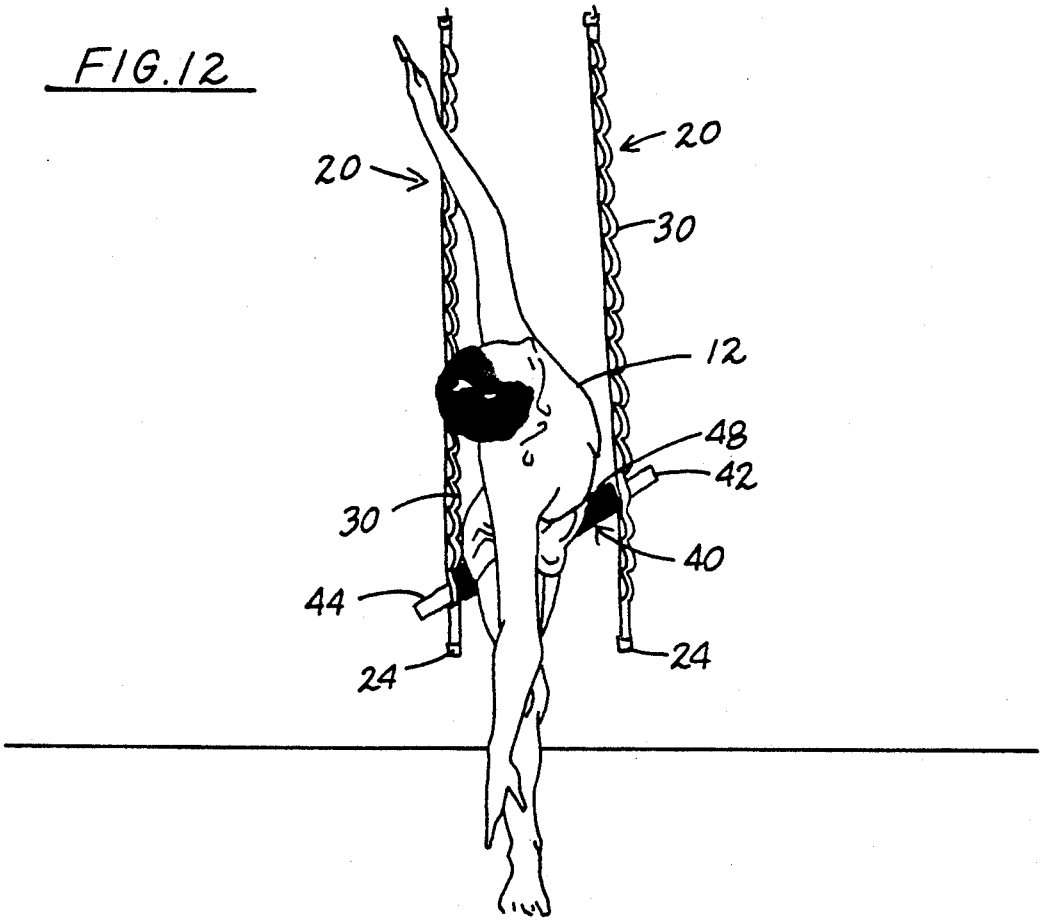

FIG. 12 is a perspective view of the apparatus showing the rigid bar in an inclined position for use in partially supporting the user's leg.

FIG. 13 is a cross sectional view of the rigid bar positioned within a loop in the flexible support member.

FIG. 14A through 14D are detail views of the preferred slide adjuster.

FIG. 15 is a perspective view of a pair of brackets used to support the flexible support members from a door.

FIG. 16 is a force sensing device used to aid in the monitoring of the forces generated during us of the proprioceptive apparatus.

FIG. 17A is a view of the force sensing pads.

FIG. 17B is a view of a computer screen and keyboard which may be used for monitoring the sensing pads shown in FIG. 17A.

DETAILED DESCRIPTION OF THE INVENTION

The subject matter which I regard as my invention is particularly pointed out and distinctly claimed in the claims. The structure and operation of my invention, together with further objects and advantages, may be better understood from the following description given in connection with the accompanying drawings, in which:

FIG. 1A through 17 shows the component parts of the proprioceptive exercise, training and therapy apparatus 10, comprising at least one flexible support member 20, preferably made of nylon material woven into a generally rectangular configuration. The flexible support members 20 provide a better hand grip surface than rope, chain or cable, and when used adjacent to the user's skin, provide a broader surface to more evenly disperse the weight of the user, eliminating rope burn and bruises which may be caused by the use of rope chain or cable.

One end of each flexible support member 20 is secured to a suitable fitting 22 which is adapted to be releasably secured to a suitable structural support means (not shown), such as a wall, ceiling, stand, tree branch, post, door, etc. Fitting 22 may be permanently secured to one end of flexible support member 20 or may be releasably secured thereto by any conventional means. Fitting 22 may secure directly to a selected structural support member (not shown), or to a releasable fitting 34, such as a J-type fitting or an S-type fitting. Fitting 22 may also be in the form of a D-ring sized to receive the flexible support member 20 therethrough. Other known fitting means may also be used.

The opposite end of the flexible support member 20 preferably also has a fitting 24 sized to receive a releasable fitting 34 thereon. The releasable fittings 34 on selected the user engagement members 36 may be secured to fitting 24, or the releasable fittings 34 may be selectively secured to one of a plurality of attachment points 30 or loops 31 secured to the flexible support member 20 in sequential linear alignment.

Figures 1A, 1B, 1C, 1D, 1E, 1F:
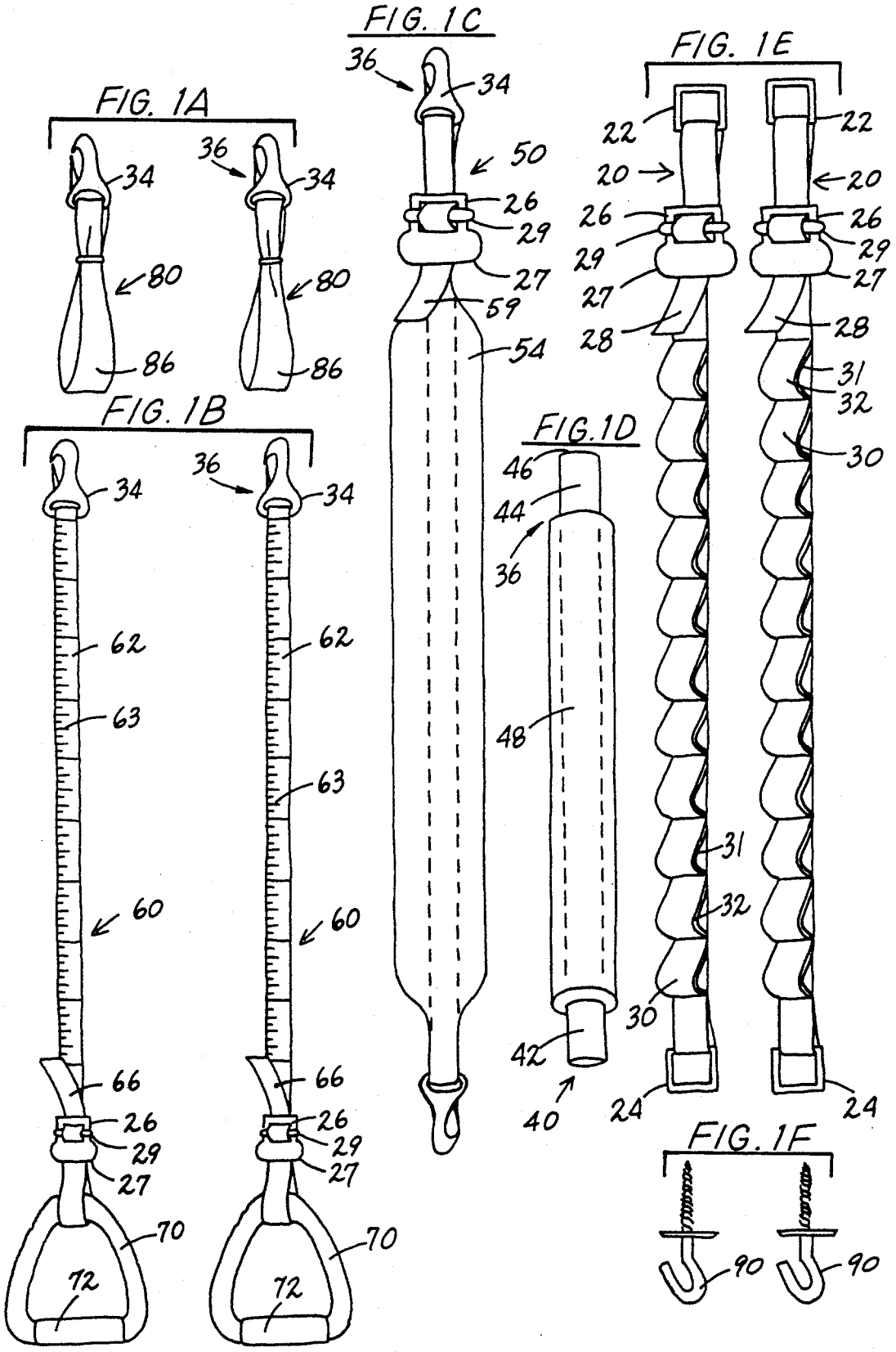
FIG. 1A through 1F are detailed views of the component parts of the invention, showing at least one flexible support member with a plurality of attachment points and an adjustable positioning means; a rigid bar; a flexible sling; and at least one hand or foot coupling member.

A plurality of attachment points 30 are disposed in sequential linear alignment on the flexible support member 20. Attachment points 30 may be any known attachment means, such as D-rings or S-hooks, etc. Preferably, attachment means are a plurality of loops 31 as shown in FIG. 1E. Loops 31 may be formed by a flexible material 32 secured to flexible strap 20 by any conventional means such as stitching, riveting, etc. Preferably, the loops 31 are made from material similar to the material used to make the flexible support member 20.

A flexible material 32 may be used within each loop 31 to provide additional resistance to rotation of the ends 42, 44 of the rigid bar 40, when inserted within a selected loop 31.

An adjustable positioning member 26, such as a buckle, slide fastener, or other known adjustable positioning means, may be secured to the flexible support member 20. The adjustable positioning member 26 provides incremental, or variable adjustment of the height of flexible support member 20, enabling the user 14 to precisely position one of the user support members 36 in relation to a desired body or limb support position. Preferably, the adjustable positioning member 26 has finger tabs 27 which extend to enable the user to easily grasp and twist the adjustable positioning mean 26 for ease of adjustment.

As shown in FIG. 14A through FIG. 14D, the adjustable positioning member 26 preferably has finger tabs 27, which may extend to each side of the adjustable positioning member 26, for ease of grasping during use. Partial rotation of adjustable positioning member 26, allows the flexible material to controllably slip within the opening 25 about slide member 29 to provide micro or macro adjustment of the length of flexible support member 20.

Macro and micro positioning of flexible strap 20 provides multiple use of the component parts of this invention, in a variety of standing, laying, sitting or bending body and limb supporting positions, as further described and disclosed in the specification and Drawings.

The adjustable positioning member 26 may be located at any location along flexible support member 20, and is preferably located above or below the attachment means 30. Flexible support member 20 end 28 may extend through adjustable positioning member 26, to provide linear adjustment of the flexible strap 20 when the user's weight is not pulling upon flexible strap 20. When at least a portion of the user's weight is placed upon flexible strap 20, the strap binds against the adjustable positioning member 26 to secure the apparatus 10 against inadvertent slippage during use.

The first user support member 36 preferably comprises a rigid bar 40 preferably having a generally rectangular cross section. The ends 42, 44 of the rigid bar 40 are perferably sized to extend through a selected loop 31 in flexible support member 20. Where other attachment points 30 are used, the rigid bar 40 is adapted with a releaseable securement means to secure the ends of the bar to a selected attachment point 30. The rigid bar 40 may be supported horizontally between flexible support members 20, or may be inclined between flexible support members 20 as shown in FIG. 12.

A resilient material 48, such as rubber, padding or flexible foam is preferably used to cover the rigid bar 40 in proximity to the user body and limb engaging portions. The ends 42, 44 of rigid bar 40 are preferably generally rectangular in cross sectional profile, and sized to be closely received in a selected loop 31 when the elongated portion of the rectangular end is parallel to the flexible support member 20. As the rigid bar is partially rotated during use, the loop 31 provides resistance to rotation, which increases as the rigid bar is rotated towards a position tangent to the flexible support member 20. A flexible material 32 may be secured within each loop 31 as previously noted, or the flexible material 32 may be secured to the rectangular ends of rigid bar 40, to suit manufacturing preference Flexible material 32 is used to provide additional resistance to rotation of rigid bar 40 during use.

The second user engagement member 36 is a flexible sling 50 preferably made of flexible strap material 52. Flexible sling 50 preferably includes a central region 54 of increased width to protect the user from rope burn, etc. during use. The central region of increased width 54 preferably extends substantially the length of the flexible strap, in proximity to placement of the user's body or limbs during use.

The flexible sling 50 may have resilient material disposed thereon, such as rubber, padding or a layer of foam, for a more comfortable support surface. Releasable fittings 34, are preferably used to secure the flexible sling 50 to a selected attachment point 30 on the flexible support member 20, or to fitting 24.

A third user engagement member 36 comprises at least one flexible hand and foot coupling member 60 or 80. The hand and foot coupling member 60 or 80 may be in the form of a loop 82 in the flexible strap 86 as shown at 80, or may include rings 70 sized to receive the user's hand or foot therein, as shown with flexible strap 60.

Where rings 70 are used, a resilient cover 72 of foam, padding or rubber preferably provides a cushioned support during use. Flexible straps 62 may be adjustably positioned and secured with an adjustable positioning means 26, as shown in FIG. 1.

Where an adjustable positioning member 26 is used, the hand and foot coupling member 60 may be adjusted by pulling upon strap end 66 to shorten flexible strap 62. Markings 63 are preferably disposed upon the flexible strap 62 for ease of positioning the proprioceptive apparatus 10, or to return the apparatus 10 to a pre-established working position.

A releasable fitting 34, provides selective securement of the flexible hand and foot coupling member 70 or 82 to the flexible support member 20. The releasable fitting 34 may be secured to fitting 24, or may be secured to a selected attachment point 30 on flexible support member 20, depending upon the adjustment required.

One or more suitable retaining means 90 may be secured to a suitable structural support member (not shown). While any means of releasable securement which will safely support the user may be used, preferably the flexible support members 20 are releasably secured to the selected structural support member for ease of positioning at selected overhead and wall mounted locations.

The user engagement members 36 disclosed herein are intended to be illustrative of a wide variety of possible user engagement members 36 (not shown), which are sized to safely support a portion of the body or limbs of the user during a selected series of proprioceptive training and therapy exercises.

Other user engagement members 36 (not shown) may also be adapted for use with the proprioceptive exercise, training and therapy apparatus disclosed, to suit specific requirements for supporting the user's body or limbs at a selected height, and such adaptations, modifications and enhancements are intended to be included within the scope of this disclosure, and the following claims.

A bracket 100 may be used to secure a flexible support member 20 to a door (not shown). The bracket 100 preferably has an aperture 102 on the front side 104. Aperture 102 is sized to slidably receive and releasably secure a flexible support member 20 thereto. Bracket 100 is sized to fit over the top of a door, and is positioned so that the top portion of the bracket 106 will engage the top of the door, while the rear portion of the bracket 108 is positioned to abut the back of the door. Bracket 100 supports flexible support member 20 against the door when at least a portion of the user's weight is applied to the proprioceptive apparatus 10.

The proprioceptive exercise, training and therapy apparatus 10 may be used by one or more users 12 at the same time. A regimen of selected proprioceptive stretching, bending, flexing, compression, tension and turning positions are preferably used to selectively support at least a portion of the user's weight at a variety of positions selected to align with a selected portion of the user's body or limbs.

The user 12 may be lying upon a floor, or other supporting apparatus during use of the proprioceptive apparatus 10 disclosed herein as shown in FIG. 4, 6, 10 and 11. Due to the adjustable alignment of the user engagement members 36, the user 12 may also use the proprioceptive apparatus 10 in a selected crouching, kneeling, stretching or standing position as shown in FIG. 2 through 12. The drawing figures referenced above are representative of some of the many positions in which the proprioceptive apparatus 10 may be used.

The proprioceptive apparatus 10 provides at least partial support of the user's body or limbs in a wide variety of possible proprioceptive positions. Due to the partial support of the user's body or limbs at a selected position and height, many proprioceptive positions not otherwise possible may be achieved by the user 12.

A proprioceptive instructor (not shown) may be used to guide the user 12 through a series of proprioceptive conditioning, training and therapy exercises. The instructor can assist the user 12 in attaining optimum positioning and alignment of the user's body in relation to the proprioceptive apparatus, and may adjust the height and position of the proprioceptive apparatus during use, to further stretch, flex, compress, tension or rotate selected body and limb areas during the proprioceptive regimen.

Figure 2:
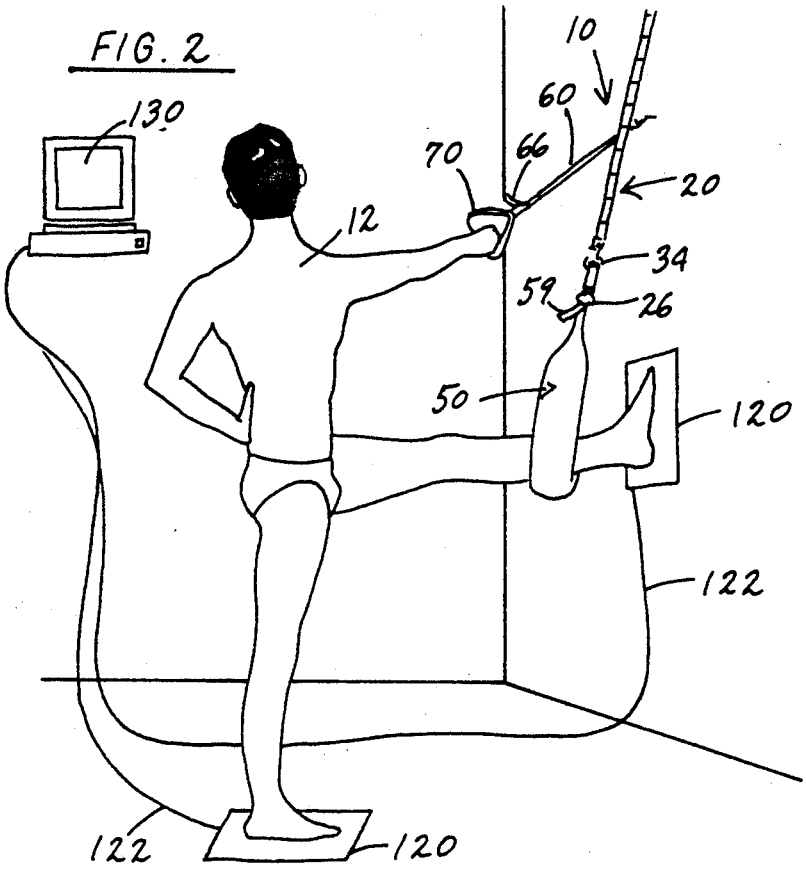
FIG. 2 is a perspective view of the apparatus, showing a user utilizing in combination a hand and foot coupling member and a flexible sling from a standing position. A force sensor with monitoring and display equipment is also shown.

FIG. 2 shows the user 12 in an upright position, standing on one foot, with the opposite foot supported by the flexible sling 50 while the opposite hand grips a hand and foot coupling 60. This exercise provides simultaneous extension and alignment promoting a selected range of motion, extension and rotation.

The adjustable positioning means 26 on flexible sling 50 may be used to provide precise alignment of the flexible sling 50 in relation to the user's leg extension. The adjustable positioning means 26 on the flexible support member 20 may be used to precisely align a selected user support member 36 in relation to the user's 12 body position.

As shown in FIG. 2, a force sensing pad 120 may be used in combination with the proprioceptive apparatus. Data from the force sensing pad 120 is communicated to a suitable data base (not shown), such as a computer, which is adapted to display data on a suitable display device 130. The user 12 may monitor the data being displayed to adjust their use of the proprioceptive apparatus, in order to achieve the desired results.

Figure 3:
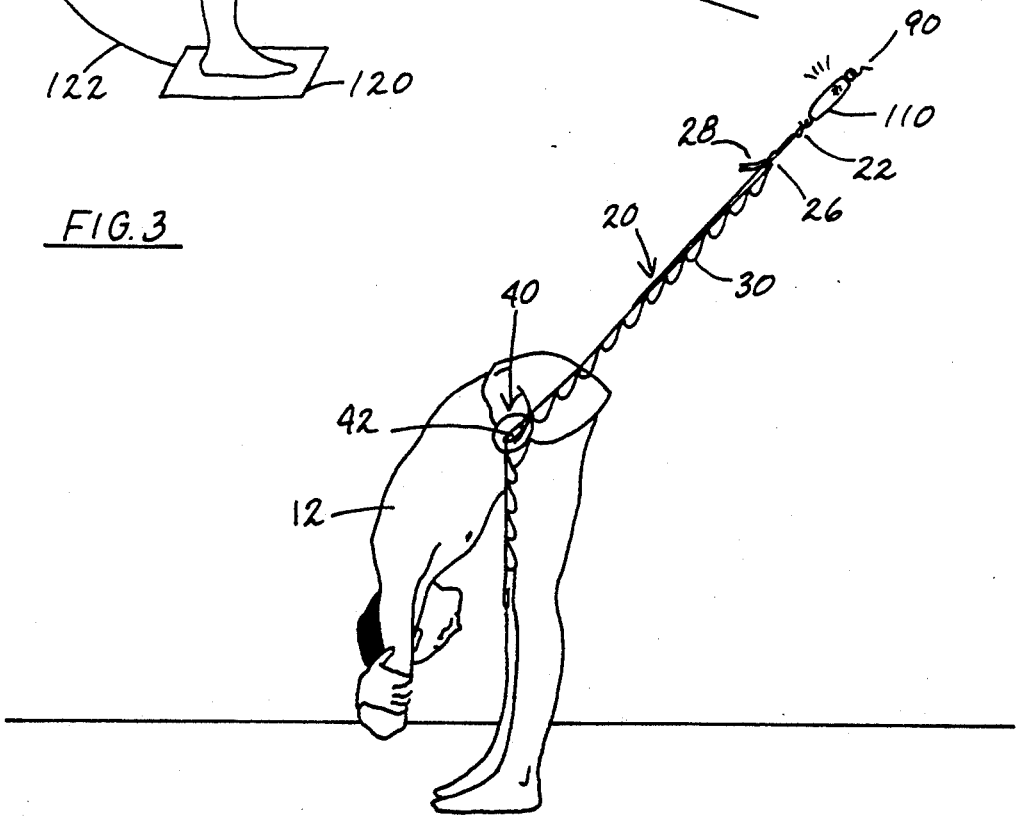
FIG. 3 is a perspective view of the apparatus, with a rigid bar attached between flexible support members, showing hip flexation over the rigid bar.

FIG. 3 shows the user 12 exercising with the rigid bar 40 positioned at the user's waist to aid in stretching the user's hamstring muscles. The rigid bar 40 rotates during use within loops 30 to adjust for the user's body motion. A force sensor 110 may be coupled between the retaining means 90 and the user engagement member 36 to monitor the force being applied during use of the proprioceptive apparatus 10.

As shown in FIG. 2, the force sensor 110 may be adapted to transmit data to a suitable display unit 130 to provide useful feedback to the user 12. It is within the scope of this disclosure to also position monitoring devices, such as force sensors, body or brain activity monitoring devices, video cameras, etc. upon the user 12 or in proximity to the proprioceptive apparatus 10 to provide monitoring and display data responsive to the use of the apparatus disclosed herein. The feedback from such devices may be displayed for interaction with the user 12, or may be remotely viewed, or recorded by any conventional means. (Not shown).

Figure 4:
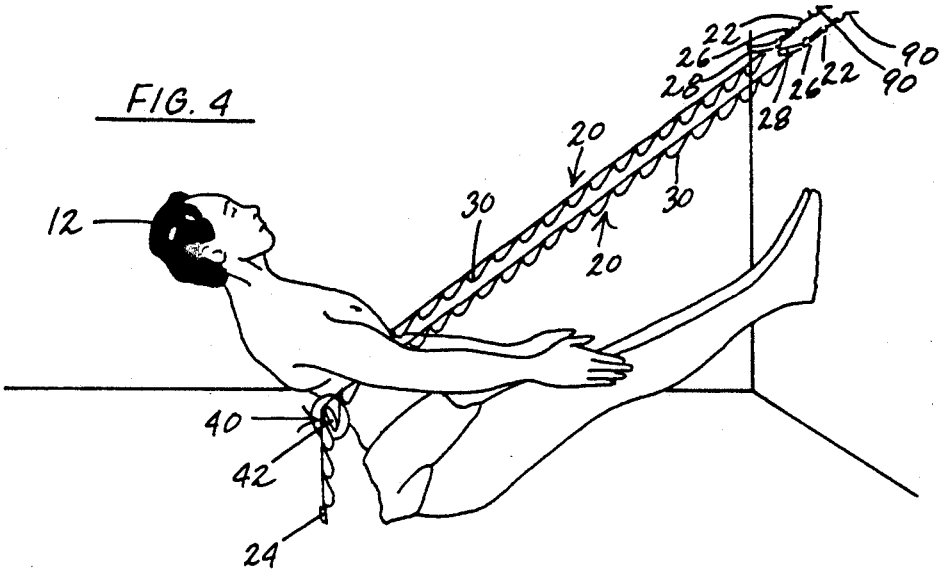
FIG. 4 is a perspective view of the apparatus with the rigid bar adjusted for use from a seated position.

FIG. 4 shows the user 12 stretching with the aid of the rigid bar 40 placed at the small of the user's back, with the user 12 in a seated position. This exercise is made possible by the lengthening of the adjustable positioning means 26 in relation to the flexible support member 20. The rigid bar 40 rotates to adjust to the contour and dynamic movement of the user's back during the proprioceptive exercise shown in FIG. 4, and does not tend to ride up or down during use, as experienced with a cylindrical bar.

Figure 5:
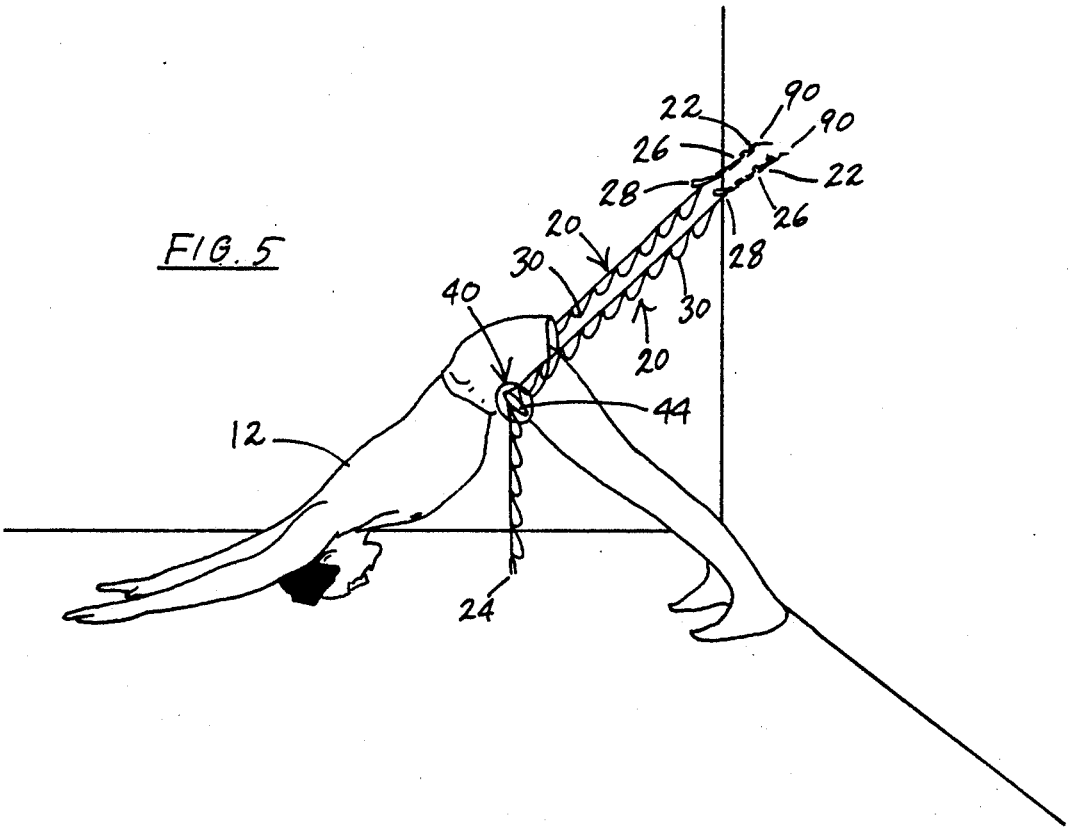
FIG. 5 is a perspective view of the apparatus showing the user flexed at the hip over the rigid bar while performing stretching exercises.

FIG. 5 shows the user 12 partially supported at the waist by the rigid bar 40. This exercise may include a rotational force on the rigid bar 40 to aid hip flexion, during flexing and stretching. The rigid bar 40 may be partially rotated by movement the user's body and limbs, or may be partially rotated with assistance of an instructor or other person (not shown).

FIG. 6 shows the proprioceptive apparatus 10 used in combination with the second user support member 36, in the form of a flexible sling member 50, which is positioned to support the forehead of the user 12 while in a seated position. The user 12 may thus exert a force from their neck or upper body against the support of the flexible sling member 50.

FIG. 7 shows the user 12 supported by the first user support member 36, to provide hamstring stretch with hip joint freedom, while providing a traction force on the user's spine. Rotation of rigid bar 40 provides a limited torque on a selected body segment, which is retained during support of the user 12. The wide rectangular portion of the user support member 40 more comfortably supports the user than a round or cylindrical rod, and freely adjusts to the user's movement during proprioceptive exercise, training or therapy.

FIG. 8 shows the proprioceptive apparatus 10 positioned to support a portion of the user's weight, as the second user support member 50 is positioned about the user's rib cage, as the user 12 flexes the hip and extends the hamstring muscles. Rotation of the upper portion of the user's body rotates the spine, as the user 12 is stabilized by the flexible sling 50

FIG. 9 shows the user partially supported by the second user support member 50 while in an extended crouching position, additionally supported by the user's feet and hand. As the user 12 rotates the upper body, hip flexion is maximized. Torque is applied by the flexible sling member 50 to the femur, as the user 12 laterally shifts their body weight. Torque may also be applied by a second person (not shown) by lifting or pushing or guiding the movement of the flexible sling member 50 during use.

FIG. 10 shows the user 12 in a seated position, with two hand and foot coupling members 60, supported by flexible support members 20 from selected structural support means having different heights. The user 12 rotates the upper body during arm extension to provide a deep opening of the thoracic, to provide hamstring stretch, and promote hip flexion. The use of multiple attachment points and the adjustable positioning of the user engagement members 36 provide a unique means to achieve proprioceptive exercise, training and therapy.

FIG. 11 is similar to FIG. 4, except the first user engagement member 36 in the form of a rigid bar 40 is positioned higher on the user's back to stabilize, support and limit extension. In this position, the rigid bar 40 holds shoulder blades down during flexing and extension of the user's arms.

FIG. 12 is a cross sectional view of the first user engagement member 36, in the form of a rigid bar 40, with end 42 positioned within a supporting loop 31. The flexible support member 20 supports a plurality of attachment points 30 secured in sequential linear alignment to provide macro adjustment of the various user engagement members 36. The loops 31 may be formed by securing a flexible strap material 32 to flexible support member 20 at linearly spaced locations.

Loop 31 is somewhat larger than the spacing between spaced locations 34, providing an aperture therethrough sized to freely receive the end of the rigid, rectangular bar 42 or 44 when no additional weight is applied to the rigid bar 40. Loop 31 is sized to provide resistance to rotation of the rectangular bar 40 ends 42, 44 when at least a portion of the user's weight is applied to the rigid bar 40 during use.

Partial rotation of the ends 42, 44 of rectangular bar 40 is accomplished by shifting the user's body in relation to the bar, as shown in FIG. 3, 5 and 7. The rectangular bar 40 may also be rotated by another person such as a trainer or instructor, or a second user, as previously noted.

Micro adjustment of the flexible support member 20 is accomplished by adjustment of the adjustable positioning member 26. Finger tabs 27 enable the user to easily grasp and rotate the adjustable positioning member 26, allowing the flexible support member 20 to controllably slide within the adjustable positioning member 26. When the adjustable positioning member 26 is released, the adjustable positioning member 26 is aided by the user's weight to resist slippage during use.

Muscle tone, balance and flexibility are achieved through conditioning the selected muscles and joints through an extended range of motion under selective compression or tension, rotation and repetition while proper alignment and support is maintained. The proprioceptive exercise, training and therapy apparatus 10 disclosed herein, makes possible a wide range of beneficial exercises.

The proprioceptive apparatus 10 is beneficial to aid balance and improve equilibrium, where balance has been impaired by sickness or injury. Muscle injury shortens muscle extension, thus affecting the user's range of motion. Scar tissue must be broken down to regain flexibility. The proprioceptive apparatus aids the user 12 in many ways not traditionally practiced with conventional exercise equipment.

The therapeutic effects of beneficial exercise on the heart, lungs, muscle tone, balance and aging are well documented. The proprioceptive exercise, training and therapy apparatus 10 herein disclosed, enables the user 10 to experience the beneficial results of a proprioceptive regimen while supporting a portion of the user's body or limbs at a selected adjustable height to suit accurate alignment of selected user engagement members 36 with a selected portion of the user's body and limbs.

From the preceding disclosure, it will be apparent that this invention provides a new and unique proprioceptive exercise, training and therapy apparatus 10, which is easy and economical to manufacture and use. The selected multiple user engagement members 36 provide a wide variety of applications for supporting at least a portion of the user's weight at an adjustably selected height, from a selected structural support positions.

The macro and micro adjustment features of the proprioceptive apparatus 10 enable the user 12 to easily position the apparatus at the desired location for each exercise, and to adjust the height of the user engagement members 36 during use.

While several embodiments of the invention have been disclosed, it will be apparent to one skilled in this art that various changes and modifications may be made to this invention without departing from the spirit or scope of this invention, and it is therefore to be understood that all modifications, variations and equivalents of this invention are meant to be encompassed within the scope of the following claims.

I claim:

1. A proprioceptive exercise, training and therapy apparatus for precisely supporting and stabilizing at least a portion of the user's body and limbs from a selected structural support, which comprises:

a) a strap attachment means releasably secured to the structural support;

b) at least one elongated strap support member releasably secured by the strap attachment means to the selected structural support, the strap support member having a plurality of discrete strap attachment loops secured in sequential linear alignment thereon, and a continuously adjustable alignment member secured to the strap support member between the strap attachment means and the discrete strap attachment loops;

c) at least one user engagement member releasably secured to a selected discrete strap attachment loop on the strap support member to support at least a portion of the user's weight thereon, and d) a continuously adjustable alignment member adapted to a adjustably position the height of the selected user engagement member is in relation to the strap support member to provide precise, selective alignment to a selected portion o the user engagement member with a selected portion of the user's body or limbs in a selected one of a desired series of user body positions.

2. The apparatus of claim 1, wherein one user engagement member comprises a rigid bar having a generally rectangular cross section, with are silent covering disposed upon the user body and limb engaging portions of the rigid bar, the rigid bar having opposing ends releasably secured to selectively positioned discrete attachment loops on two spaced apart strap support members.

3. The apparatus of claim 2, wherein at least one of the discrete star attachment loops secured to the strap support member in sequential linear alignment is lined with a resilient material sized to provide controlled resistance to rotation of a rectangular bar placed within the loop, while at least a portion of the user's weight is supported by the rectangular bar.

4. The apparatus of claim 1, wherein one user engagement member comprises a body sling having a central region of increased width in proximity to the user body engaging portion, with the ends of the sling releasably secured to a selected discrete attachment loop on the strap support member, and with a continuously adjustable alignment member adapted to precisely, adjustably position the height of the selected user engagement member with a selected portion of the user's body and limbs at a selected user body position.

5. The apparatus of claim 1, wherein at least one user engagement member comprises a hand and foot coupling member comprising a strap with one end adapted for selective releasable securement to a selected discrete attachment loop on at least one strap support member or from at least one selected structural support means, and the other end of the strap adapted to selectively support the user's hand or foot, with a adjustable alignment member disposed therebetween, the adjustable alignment member adapted to precisely, adjustably position the height of the selected user engagement member for alignment to a selected portion of the selected user engagement member with a selected position on the user's body and limbs.

6. The apparatus of claim 1, wherein at least one strap attachment means is releasably secured to a structural support selected from at least one overhead structural support means, and at least one vertically positioned structural support means located above the surface of the floor.

7. The apparatus of claim 1, wherein one selected structural support is a bracket releasably secured to a strap support member, the bracket sized to fit over the top of a door and positioned to retina the bracket against the door when the door is closed, and when at least a portion of the user's weight is applied to the strap support member.

8. The apparatus of claim 5, wherein a plurality of markings are provided upon the strap of the hand and foot coupling member for ease of precise alignment and repositioning of the apparatus.

9. The apparatus of claim 1, wherein the continuously adjustable alignment member comprises a bracket having an aperture sized to receive the strap support member therethrough, with a sliding member positioned to bias the strap support member, and with finger taps extending from the bracket for ease of rotation of the bracket to aid in slidably positioning the strap support member, during use.

10. The apparatus of claim 1, wherein a force sensor is positioned in proximity to the proprioceptive apparatus, the force sensor responsive to a change or shift in the user's weight during use of the proprioceptive apparatus, with a visual or audible means provided to monitor the data received from the force sensor, to provide feedback of the user, responsive to the user's movements, during use of the apparatus.

11. The apparatus of claim 1, wherein the body and limb engaging portion of the selected user engagement member is substantially covered with a resilient material.

12. A proprioceptive exercise, training and therapy apparatus for supporting at least a portion of a user's body and limbs from at least one selected structural support, which comprises:

a) at least one elongated strap support member having a strap attachment means at one end, for releasable securement to a selected structural support, the strap support member having a least one discrete loop, with a continuously adjustable alignment member secured between the discrete loop and the strap attachment means to precisely position the discrete loop in relation to the structural support;

b) at least one user engagement member in the form of a rigid, rectangular bar with ends adapted for releasable securement to the selected discrete loop on the strap support member;

c) at least one user engagement member in the form of a flexible body sling, with the ends of the align adapted for releasable securement to the selected discrete loop on the strap support means and a continuously adjustable strap alignment member secured to the body sling between the ends of the sling, for precise adjustment and alignment during use;

d) at least one user engagement member in the form of a hand and foot coupling member adapted for selective, releasable securement to the discrete loop on the strap support member or to the structural support means, and a continuously adjustable strap alignment member secured to the hand and foot coupling member, for precise adjustment and alignment of the hand and foot coupling member during use, to perform a series of proprioceptive exercise, training and therapy exercises, using selected user engagement members at precisely selected body and limb engaging heights.

13. The apparatus of claim 12 wherein a continuously adjustable alignment member is adapted to adjustably position the height of the selected user engagement member to suit precise alignment of a selected portion of the user engagement member with a selected portion of the user's body and limbs in a selected user body position, during.

14. The apparatus of claim 12 wherein at least one strap attachment means is secured to a structural support selected from at least one overhead structural support means, and at least one vertically positioned structural support means located above the surface of the floor.

15. The apparatus of claim 12, wherein one selected structural support is a bracket releasably secured to the strap support member, the bracket sized to fit over the top of a door and positioned to retain the bracket against the door when the door is flossed, and at least a portion of the user's weight is applied to the strap support member.

16. The apparatus of claim 12, wherein a force sensor is positioned in proximity to the proprioceptive apparatus, the force sensor is responsive to a change in the user's weight during use of the proprioceptive apparatus and means is provided to monitor the data received from the force sensor, to provide audible or visual feedback to the user of the proprioceptive apparatus, during use.

17. The apparatus of claim 12, wherein the elongated strap support member is made of a first woven my long strap having a generally rectangular configuration, and a second woven nylon strap having a generally rectangular configuration, the first and second woven nylon straps secured at a plurality of attachment points, with the length of the second strap greater than the length of the firs strap between attachment points, forming a plurality of discrete loops secured to the strap support member in sequential linear alignment.

18. A proprioceptive exercise, training and therapy apparatus for precisely supporting at least a portion of the user's body and limbs from a selected structural support at a selected height from the floor, which comprises:

a) a strap attachment means releasably secured to the selected structural support;

b) at least two elongated strap support members each having at least one discrete loop, each strap support member having a continuously adjustable alignment member, and a strap attachment means for releasably securement to the selected structural support;

c) a first user engagement member is n the form of a rigid elongated bar having a generally rectangular cross section, with a resilient material disposed upon at least a portion of the bar, and the ends of the rigid bar adapted for releasable securement to a selected discrete loop on the strap support member;

d) a second user engagement member having a body sling with the ends of the body sling adapted of releasable securement to a selected discrete loop on the strap support member, with a continuously adjustable alignment member secured to the second user engagement member between the ends of the body sling;

e) a third user engagement member in the form of at least one headband foot coupling member adapted for releasable securement to a selected discrete loop on this trap support member, with a continuously adjustable alignment member secured to the third user engagement member;

wherein the selected user engagement member is precisely aligned and positioned in relation to the user's body and limbs.

19. The apparatus of claim 18, wherein a plurality of discrete loops are secured to the strap support member in sequential linear alignment, nd the discrete loops are each sized to freely receive the ends of the rigid rectangular first user engagement member when no additional weight is applied to the rectangular bar, and the discrete loops are sized to provide controlled resistance to rotation of the rigid rectangular first user engagement member when at least a portion of the user's weight is applied to rotation of the first user engagement member, during use.

20. The apparatus of claim 18, wherein the continuously adjustable alignment member comprises a bracket having an aperture sized to receive the strap support member therethrough, with a sliding member positioned to bias the strap support member, and extended finger tabs extending from the bracket for ease of rotation of the bracket to aid in slidably positioning the strap support member.

21. The apparatus of claim 18, wherein a force sensor is positioned in proximity to the proprioceptive apparatus, the force sensor responsive to a change in the user's weight during use of the proprioceptive apparatus, and a visual or audio means is provided to monitor the data received from the force sensor, to provide feedback to the user, responsive to the user's movement, during use of the apparatus.

22. The apparatus of claim 18, wherein a plurality of markings are provided upon the straps of the hand and foot coupling member for ease of precise alignment, adjustment and repositioning of the apparatus, during use.

* * * * *